United States Patent [19]

Motz et al.

[11] Patent Number: 4,926,582

[45] Date of Patent: May 22, 1990

[54] LOW POUR CRUDE OIL COMPOSITIONS

[75] Inventors: Kaye L. Motz, Ponca City, Okla.; Roger A. Latham, Carouge, Switzerland; Robert J. Statz, Kennett Square, Pa.

[73] Assignee: E. I. duPont de Nemours & Company, Wilmington, Del.

[21] Appl. No.: 202,151

[22] Filed: Jun. 2, 1988

[51] Int. Cl.[5] ..... C10L 1/16; C10L 1/22

[52] U.S. Cl. ..... 44/62; 137/13; 44/70

[58] Field of Search ..... 252/50, 51; 44/62, 70; 137/13

[56] References Cited

U.S. PATENT DOCUMENTS

| | | | |
|---|---|---|---|
| 3,693,720 | 9/1972 | McDougall | 252/8.55 B X |
| 3,832,302 | 8/1974 | Lansford et al. | 210/58 |
| 3,947,368 | 3/1976 | Sweeney | 252/56 R |
| 3,957,659 | 5/1976 | van de Kratts | 252/51.5 A X |
| 4,062,796 | 12/1977 | Gardner et al. | 252/180 |
| 4,127,140 | 11/1978 | Sweeney | 44/62 |
| 4,135,887 | 1/1979 | Rossi | 44/62 |
| 4,160,459 | 7/1979 | Sweeney | 44/62 |
| 4,178,951 | 12/1979 | Sweeney | 44/62 |
| 4,194,984 | 3/1980 | Elliott | 252/50 X |
| 4,419,106 | 12/1983 | Miller | 44/62 |
| 4,547,202 | 10/1985 | Miller | 44/62 |
| 4,726,811 | 2/1988 | Miller | 44/62 |

FOREIGN PATENT DOCUMENTS

| | | | |
|---|---|---|---|
| 94893 | 6/1968 | France | 252/50 |
| 1240760 | 6/1986 | U.S.S.R. . | |
| 787055 | 3/1956 | United Kingdom . | |
| 1436763 | 5/1976 | United Kingdom | 252/50 |

OTHER PUBLICATIONS

Chemical Abstract, vol. 105, No. 192492t, "Polymers of Vinyl Acetate, Olefins and Acrylonitrile as Antistatic Agents and Pour-Point Depressants", (1986).

*Primary Examiner*—William R. Dixon, Jr.
*Assistant Examiner*—James M. Hunter, Jr.
*Attorney, Agent, or Firm*—C. R. Schupbach

[57] ABSTRACT

A low pour point crude oil composition is prepared by incorporating in a waxy crude oil an effective pour point depressant amount of an oil soluble ethylene-acryonitrile copolymer or terpolymer. The copolymer or terpolymer is usually added as a solution. In one aspect the invention relates to the pipeline transportation of the low pour crude oil composition.

14 Claims, No Drawings

LOW POUR CRUDE OIL COMPOSITIONS

BACKGROUND AND SUMMARY OF THE INVENTION

Certain waxy, high-pour crude oils are known to have poor pipeline flow characteristics and, in addition, they exhibit a tendency to gel at temperatures encountered during transportation. This tendency is particularly troublesome when a pipeline containing these crudes is shut down under low ambient temperatures.

A number of processes have been suggested in the art for dealing with such flow problems. For example, the pour point of waxy curdes have been improved by the removal of a part of the wax by solvent extraction at low temperatures, with the attendant expense of recovering the solvent, and the problem of disposing of the wax and of providing the cooling requirements, which are substantial. In more recently proposed processes, wax has been removed without the use of a solvent by centrifuging a previously heated crude which has been cooled at a critically controlled and slow rate to a centrifuging temperature of around 35°-55° F.

Another widely practiced process involves cutting the waxy crudes with lighter fractions of hydrocarbons. This process suffers from a number of disadvantages, such as the fact that the procedure involves the use of relatively large amounts of expensive hydrocarbon solvents to transparent a relatively cheap product. Furthermore, this practice also necessarily requires that the cutting hydrocarbon solvents be available in suitable quantities which in some instances is inconvenient, and also that there be a ready market for the solvents at the other end of the pipeline.

In another method, heating equipment installed along the pipeline at frequent intervals is utilized to heat the crude and thus reduce its viscosity. Heaters employed for this purpose can be operated by withdrawing from the crudes being transported for use as fuels. As much as 5 percent of the crude may be utilized in providing the heating necessary for reducing the crude oil viscosity to a suitable value. Furthermore, most pipelines are not equipped with such heating installations. Also, there is the additional problem of contamination of the atmosphere when burning crude oils, since they may be difficult to burn completely.

According to this invention, an effective pour point depressant amount of a copolymer of ethylene and acrylonitrile is incorporated in a waxy crude oil to provide a composition having good pipeline flow characteristics and a reduced tendency to gel at temperatures encountered during transportation such crude oil.

PRIOR ART

British Patent No. 787,055 to Esso Research and Engineering Company discloses the use of oil soluble copolymers of ethylene and/or propylene and a nitrogen-containing unsaturated organic compound, such as acryonitrile as a detergent additive in lubricating oils. The reference further discloses that such copolymers, when modified by a side chain containing 8-18 carbon atoms, may impart additional properties, such as V.I. improving properties or pour point depressing properties in the refined products used as lubricants.

U.S. Pat. No. 4,062,796 to Gardner et al. discloses the use of the reaction product of a polyelectrolytic organic polymer and an organic surfactant to prevent the deposition of scale in aqueous solutions. The organic polymer may be an acrylonitrile copolymer with ethylene or propylene.

U.S. Pat. No. 3,693,720 to McDougall et al. discloses the use of a polymer comprising an ethylene moiety, a nonpolar moiety, such as acrylonitrile, and a polar moiety, such as acrylic acid to inhibit wax deposition on surfaces contacting crude oils.

U.S. Pat. No. 3,832,302 to Lansford et al. discloses a composition for inhibiting scale in an aqueous system formed by the reaction of a water soluble polyelectrolytic organic polymer having a molecular weight from 1,000 to 100,000 and a water-soluble organic cationic surface active compound. The organic polymer may be a copolymer of an olefin, such as ethylene with a compound having the formula $$CH_2{=}\overset{\overset{\displaystyle R}{|}}{C}{-}R_1$$

in which R may be hydrogen and $R_1$ may be a nitrile radical.

DETAILED DESCRIPTION OF THE INVENTION

The ethylene-arcylonitrile copolymers used in this invention may be prepared by polymerization of ethylene and acrylonitrile or by reacting acrylic acid with ethylene and pyrolyzing with ammonia to obtain the copolymer. These copolymers are well known in the art, and procedures for their preparation are readily available. The composition of the copolymers will vary. However, usually the amount of acrylonitrile in the copolymer is between about 1 and about 35 weight percent, and more usually between about 10 and about 20 weight percent.

The ethylene-acrylonitrile terpolymers may be prepared by polymerization of ethylene, acrylonitrile and a third monomer. Third monomers used non-exhaustively include vinyl acetate, carbon monoxide, alkyl acrylates, alkyl methacrylates, alkyl vinyl ethers, vinyl chloride, vinyl fluoride, acrylic acid and methacrylic acid. The various terpolymers used in the compositions of the invention are known in the art as are the procedures for their preparation. The amount of the third monomer in the terpolymers will vary from about 0.1 to about 10 weight percent, but usually is between about 1 and 5 weight percent.

It is possible to modify ethylene-acrylonitrile copolymers and terpolymers by adding hydrocarbon side chains to the polymers. However, in the crude oil compositions of this invention the ethylene-acrylonitrile copolymers and terpolymers are employed without such modification.

Depending on the polynmerization conditions used, particularly the temperature of polymerization, the copolymers and terpolymers may vary in melt index as measured by ASTM D1238-E (which is related to molecular weight). The melt index of the copolymers and terpolymers may be from as low as 1 to as high as 4000. More usually the melt index will be between about 1 and about 300.

The ethylene-acrylonitrile copolymers and terpolymers are usually solid or semi-solid at room temperature. While it is possible to introduce the copolymer or terpolymers to the waxy crude oil in the form of a solid, it is desirable for ease of handling to place the copolymer or terpolymer in solution before adding it to the waxy crude oil. This may be accomplished through the use of an aromatic solvent, such as toluene or xylene or, if preferred, a refinery stream high in aromatics, such as ethylene cracker bottoms, may be used for this purpose.

Although the crude oil compositions of this invention may be prepared using any crude oil containing wax, the ethylene-acrylonitrile copolymer and terpolymer pour point depressants are especially effective with high pour waxy crude oils. These copolymers and terpolymers find particular application in waxy crude oils obtained from areas such as India, Egypt and the British North Sea; however, they are useful in other waxy materials.

The amount of the ethylene-acrylonitrile copolymer or terpolymer incorporated in the crude oil compositions of this invention may be varied over a wide range. Generally, the amount of copolymer or terpolymer in the crude oil composition will be from about 1.0 to about 2000 parts per million by weight, and preferably between about 1 and about 500 parts per million. However, any amount of the copolymer or terpolymer which will provide a reduction in pour point may be used within the scope of the invention.

This invention is especially applicable to the pipelining of waxy crudes over substantial distances, particularly where the pipeline is subject to varying temperature conditions. It is also applicable, however, to situations where crudes are moved over short distances. For example, it may be used in off-loading of offshore platforms, in getting lines in oil fields and in the storage and transfer of crude oil in refineries.

The following examples illustrate the results obtained in carrying out the invention.

A number of polymers containing nitrile group (derived from acrylonitrile) were tested as pour point depressants in Bombay High, an Indian crude. One thousand parts pre million depressant material was added to the crude which was heated to a temperature of 122° F. The pour point of each crude sample was then determined by ASTM Method D-97.

TABLE 1

| Pour Point Depressant* | Pour Point (°F.) |
|---|---|
| Blank | 85 |
| 75 Styrene/25 Acrylonitrile | 85 |
| 68 Styrene/32 Acrylonitrile | 80 |
| 79 Butadiene/21 Acrylonitrile | 90 |
| 74 Butadiene/26 Acrylonitrile | 85 |
| 63 Butadiene/37 Acrylonitrile (Hydrogenated) | 85 |
| 85 Ethylene/10 Vinyl Acetate/5 Methacrylonitrile | 85 |
| 69 Ethylene/18 Vinyl Acetate/13 Acrylonitrile | 35 |
| 82 Ethylene/18 Acrylonitrile | 20 |
| 84 Ethylene/16 Acrylonitrile | 20 |
| 85 Ethylene/5 Carbon Monoxide/10 Acrylonitrile | 15 |
| 79 Ethylene/16 Vinyl Acetate/5 Acrylonitrile | 20 |

*The numbers represent weight percent.

It is noted that the two ethylene-acrylonitrile copolymers tested both provided a substantial reduction in pour point. Both of the ethylene-vinyl acetate-acrylonitrile terpolymers also provided a similar reduction as did the terpolymer of ethylene, carbon monoxide and arcylonitrile.

An ethylene-acrylonitrile copolymer containing 18 weight percent acrylonitrile (EAN 18) was tested at various concentrations in Bombay High crude in a similar manner. The results are presented in Table 2.

TABLE 2

| Conc. (ppm) | Pour Point (°F.) |
|---|---|
| 0 | 85 |
| 50 | 45 |
| 100 | 40 |
| 250 | 40 |
| 500 | 35 |
| 1000 | 20 |

The same ethylene-acrylonitrile copolymer was compared with Shellswin 5X in Bombay High crude. Shellswim 5X is a pour point depressant provided by Shell Oil Company. One hundred parts per million of each pour point depressant were used in the Bombay High crude which had been heated to 122° F. The results of the comparison are shown in Table 3.

TABLE 3

| Pour Point Depressant | Pour Point (°F.) |
|---|---|
| Blank | 85 |
| Shellswim 5X* | 70 |
| EAN 18 | 35 |

*Polyalkylacrylate polymer (containing C-18 to C-22 groups).

The pour point advantage of the ethylene-acrylonitrile copolymer is apparent from the data.

The same ethylene-acrylonitrile copolymer was tested in Geisum crude obtained from Egypt at several concentrations. The results are shown in Table 4.

TABLE 4

| Conc. (ppm) | Pour Point - °F. EAN 18 |
|---|---|
| 0 | 85 |
| 50 | 60 |
| 100 | 40 |
| 250 | 10 |

A similar pour point advantage of the ethyleneacrylonitrile copolymer is seen here also.

The same ethylene-acrylonitrile copolymer was compared with two other pour point depressants in several Egyptian crudes. 150 parts per million of each material was added to crudes heated to a temperature of 122° F. The results are shown in table 5.

TABLE 5

| | POUR POINTS (°F.) | | | |
|---|---|---|---|---|
| | Blank | EAN 18 | CF 2315* | Shellswim 11T** |
| Umbarka | 80 | 75 | 60 | 75 |
| Safir | 65 | 20 | 30 | 35 |
| Agiba | 60 | <5 | — | <5 |

*Polymer(s) containing ethylene, vinylacetate, alkyl acrylate and alkyl succinates.
**Vinylpyridine-alkylacrylate copolymer.

The same ethylene-acrylonitrile copolymer was tested in a number of crudes from N. Dak., The Peoples Republic of China, and the British North Sea. Various concentrations of the copolymer were tested in crudes heated to 165° F. The results are shown in Table 6.

TABLE 6

| Crude | Conc. (ppm) | POUR POINT (°F.) Blank | EAN 18 |
|---|---|---|---|
| Henry Fritch* | 1000 | 115 | 70 |
| Henry Fritch* | 50 | 115 | 75 |
| DaQuing** | 500 | 95 | 70 |
| Zohn UAN** | 500 | 95 | 80 |

TABLE 6-continued

| Crude | Conc. (ppm) | POUR POINT (°F.) Blank | EAN 18 |
|---|---|---|---|
| Liao He** | 100 | 75 | 40 |
| Hua Bei** | 100 | 100 | 80 |
| Beatrice*** | 250 | 85 | 35 |

*North Dakota.
**Peoples Republic of China.
***British North Sea.

The same ethylene-acrylonitrile copolymer was tested for gel strength in Bombay and Safir crudes, along with two Shell materials (Shellswim 5X and Shellswim 11T). Pertinent test data and results are shown in Table 7.

TABLE 7

| Crude | PPD | Conc. (ppm) | Prep. Temp. (°F.) | Dynamic Cooling (to °F.) | Hold Temp. (°F.) | Gel Strength (lbs/100 ft) |
|---|---|---|---|---|---|---|
| Bombay | — | — | 122 | 98 | 68 | 312.0 |
| Bombay | EAN 18 | 100 | 122 | 98 | 68 | 1.7 |
| Bombay | Shellswim 5X | 150 | 122 | 98 | 68 | 5.2 |
| Safir | — | — | 140 | 60 | 32 | 365.0 |
| Safir | EAN 18 | 100 | 140 | 60 | 32 | 130.3 |
| Safir | Shellswim 11T | 250 | 140 | 60 | 32 | 195.5 |

It is noted from the data that the ethylene-acrylonitrile copolymer, even in lower concentrations, provide better gel strength than the two Shell materials.

Wax depositions studies were made on Bombay High crude with the same ethylene-acrylonitrile copolymer and two other materials: Ethylene-vinylacetate-methacrylic acid terpolymer and Shellswim 5X. The results are shown in Table 8.

TABLE 8

| PPD | Conc. (ppm) | Wax Reduction (Percent) |
|---|---|---|
| EAN 18 | 1000 | 90 |
| EAN 18 | 50 | 80 |
| EAN 18 | 10 | 20 |
| Ethylene-vinylacetate-methacrylic acid terpolymer | 1000 | 50 |
| Shellswim 5X | 1000 | 33 |

The data in Table 8 indicates the superiority of the ethylene-acrylonitrile copolymer as a paraffin deposition inhibitor.

Four ethylene-acrylonitrile copolymers were prepared. The composition of the copolymers and their melt indices are shown in Table 9.

TABLE 9

| Sample No. | Ethylene Weight Percent | Acrylonitrile Weight Percent | Melt Index |
|---|---|---|---|
| 1 | 94.5 | 5.5 | 3 |
| 2 | 89.0 | 11.0 | 8 |
| 3 | 84.0 | 16.0 | 40 |
| 4 | 69.0 | 31.0 | >100 |

The above copolymers were tested for pour point in a number of crudes obtained from around the world. The results of the tests are shown in Table 10.

TABLE 10

| Sample | Crude | PPM | Temp. (°F.) | Pour Point (°F.) |
|---|---|---|---|---|
| 1 | Bombay | 1000 | 74 | 85 |
| 2 | Bombay | 1000 | 74 | 50 |
| 3 | Bombay | 1000 | 74 | 40 |
| 4 | Bombay | 1000 | 74 | 35 |
| 1 | Bombay | 200 | 50 | 80 |
| 2 | Bombay | 200 | 50 | 70 |
| 3 | Bombay | 200 | 50 | 55 |
| 4 | Bombay | 200 | 50 | 80 |
| 2 | Bombay | 200 | 74 | 70 |
| 3 | Bombay | 200 | 74 | 50 |
| 4 | Bombay | 200 | 74 | 75 |
| | Ecopetrol(1) | | | |
| 2 | Ecopetrol | 50 | 40 | 75 |
| 3 | Ecopetrol | 50 | 40 | 45 |
| 4 | Ecopetrol | 50 | 40 | 75 |
| 3 | Ecopetrol | 10 | 46 | 75 |
| 3 | Ecopetrol | 50 | 46 | 70 |
| 3 | Ecopetrol | 100 | 46 | 35 |
| 2 | Ecopetrol | 100 | 46 | 65 |
| 3 | Ecopetrol | 100 | 46 | 15 |
| 4 | Ecopetrol | 100 | 46 | 65 |
| 3 | Ecopetrol | 250 | 46 | −30 |
| | Marathon(2) | | | |
| 3 | Marathon | 1000 | 70 | 80 |
| 3 | Marathon | 1500 | 70 | 70 |
| 3 | Kotter(3) | 50 | 74 | 45 |
| 3 | Kotter | 500 | 74 | 55 |
| | Dulang(4) | | | 95 |
| 3 | Dulang | 1000 | 60 | 100 |
| 4 | Dulang | 1000 | 60 | 100 |
| | Myton(5) | | | 45 |
| 3 | Myton | 1000 | 46 | −10 |
| 4 | Myton | 1000 | 46 | −10 |
| | Daqing | | | 80 |
| 3 | Daqing | 1000 | 60 | 60 |
| | Delhi(6) | | | 70 |
| 3 | Delhi | 1000 | 60 | 70 |
| 4 | Delhi | 1000 | 60 | 70 |
| 3 | Delhi | 200 | 46 | 65 |
| 2 | Delhi | 200 | 46 | 70 |
| 4 | Delhi | 200 | 46 | 70 |
| | Kalda(7) | | | 75 |
| 3 | Kalda | 1000 | 60 | 25 |
| 4 | Kalda | 1000 | 60 | 40 |
| | New Zealand | | | 85 |
| 2 | New Zealand | 1000 | 46 | 85 |
| 3 | New Zealand | 1000 | 46 | 85 |
| 4 | New Zealand | 1000 | 46 | 85 |
| | Ewing Banks(8) | | | 40 |
| 2 | Ewing Banks | 1000 | 46 | 20 |
| 3 | Ewing Banks | 1000 | 46 | 10 |
| 4 | Ewing Banks | 1000 | 46 | −20 |
| | Myton Station | | 80/46 | 100 |
| 3 | Myton Station | 1000 | 80/46 | 100 |
| 4 | Myton Station | 1000 | 80/46 | 100 |
| | LSWR(9) | | | 125 |
| 3 | LSWR | 1000 | 60 | 125 |
| 4 | LSWR | 1000 | 60 | 125 |
| | Dickinson(10) | | | 95 |
| 3 | Dickinson | 1000 | 60 | 50 |

TABLE 10-continued

| Sample | Crude | PPM | Temp. (°F.) | Pour Point (°F.) |
|---|---|---|---|---|
| 4 | Dickinson | 1000 | 60 | 50 |

(1)Columbia
(2)Tunisia
(3)British North Sea
(4)Peoples Republic of China
(5)Utah
(6)India
(7)Egypt
(8)Gulf Coast - USA
(9)Malaysia - Low sulfur resid
(10)North Dakota

We claim:

1. In the process of transporting waxy curde oils through a pipeline, the improvement which comprises incorporating into said crude oil an effective pour point depressant amount of an additive comprising a polymer selected from the group consisting of copolymers of ethylene and acrylonitrile, and terpolymers of ethylene, acrylonitrile, and a third monomer selected from the group consisting of vinyl acetate, carbon monoxide, alkyl acrylates, alkyl methacrylates, alkyl vinyl ethers, vinyl chloride, vinyl fluoride, acrylic acid, and methacrylic acid, wherein the amount of third monomer in the terpolymer ranges from about 0.1 to about 10.0 precent by weight.

2. The process of claim 1 in which between about 1 and about 4000 parts per million by weight of a copolymer is incorporated in the crude oil.

3. The process of claim 2 in which the copolymer contains from about 1 to about 35 weight percent acrylonitrile.

4. The process of claim 3 in which the melt index of the copolymer is between about 1 and about 4000.

5. The process of claim 1 in which between about 0.1 and about 1000 parts per million by weight of a terpolymer is incorporated in the crude oil.

6. The process of claim 5 in which the terpolymer contains from about 1 to about 35 weight percent acrylonitrile, from about 1 to about 10 weight percent of third monomer and remainder ethylene.

7. The process of claim 6 in which the melt index of the terpolymer is between about 1 and about 4000.

8. A process for improving the pour point characteristics of a waxy crude oil comprising incorporating into said crude oil an effective pour point depressant amount of an additive comprising a polymer selected from the group consisting of copolymers of ethylene and acrylonitrile, and terpolymers of ethylene, acrylonitrile, and a third monomer selected from the group consisting of vinyl acetate, carbon monoxide, alkyl acrylates, alkyl methacrylates, alkyl vinyl ethers, vinyl chloride, vinyl fluoride, acrylic acid, and methacrylic acid, wherein the amount of third monomer in the terpolymer ranges from about 0.1 to about 10.0 percent by weight.

9. The process of claim 8 in which the incorporated polymer is a copolymer containing from about 1 to about 35 weight percent acrylonitrile.

10. The process of claim 9 in which between about 0.1 and about 1000 parts per million be weight of the copolymer is incorporated in the crude oil.

11. The process of claim 10 in which the melt index of the copolymer is between about 1 and about 4000.

12. The process of claim 8 in which the incorporated polymer is a terpolymer containing from about 1 to about 35 weight percent acrylonitrile, from about 1 to about 10 weight percent of third monomer and the remainder ethylene.

13. The process of claim 12 in which between about 0.1 and about 1000 parts per million by weight of the terpolymer is incorporated in the crude oil.

14. The process of claim 13 in which the melt index of the terpolymer is between about 1 and about 4000.

* * * * *

UNITED STATES PATENT AND TRADEMARK OFFICE

CERTIFICATE OF CORRECTION

PATENT NO. : 4,926,582

DATED : May 22, 1990

INVENTOR(S) : Kaye L. Motz, Roger A. Latham, and Robert J. Statz

It is certified that error appears in the above-identified patent and that said Letters Patent is hereby corrected as shown below:

Column 2, line 55, "polynmerization" should be --polymerization--.

Column 3, line 19, "1.0", should be --0.1--.

Signed and Sealed this

Eighth Day of October, 1991

*Attest:*

HARRY F. MANBECK, JR.

*Attesting Officer*

*Commissioner of Patents and Trademarks*